US005758225A

United States Patent [19]

Yoo et al.

[11] Patent Number: 5,758,225

[45] Date of Patent: May 26, 1998

[54] METHOD AND DEVICE FOR SUPPLYING A VARIABLE BIAS VOLTAGE TO A DEVELOPING ROLLER

[75] Inventors: Yong-Baek Yoo; Duk-Soo Kim, both of Kyungki-do, Rep. of Korea

[73] Assignee: Samsung Electronics Co., Ltd., Suwon, Rep. of Korea

[21] Appl. No.: 351,015

[22] Filed: Dec. 8, 1994

[30] Foreign Application Priority Data

Dec. 18, 1993 [KR] Rep. of Korea ..... 28366/1993

[51] Int. Cl.[6] ..... G03G 15/08

[52] U.S. Cl. ..... 399/55; 399/56

[58] Field of Search ..... 355/246, 259, 355/265; 399/55, 56

[56] References Cited

U.S. PATENT DOCUMENTS

| | | | |
|---|---|---|---|
| 4,600,294 | 7/1986 | Suzuki et al. | 355/246 |
| 4,755,850 | 7/1988 | Suzuki et al. | 355/265 |
| 4,990,961 | 2/1991 | Ueno et al. | 355/246 X |
| 5,198,861 | 3/1993 | Hasegawa et al. | 355/246 |
| 5,287,149 | 2/1994 | Hoshika | 355/246 |
| 5,521,683 | 5/1996 | Miyamoto et al. | 399/55 |

FOREIGN PATENT DOCUMENTS 4-63375 2/1992 Japan .

*Primary Examiner*—Nestor Ramirez
*Attorney, Agent, or Firm*—Cushman Darby & Cushman IP Group of Pillsbury Madison & Sutro LLP

[57] ABSTRACT

A method and a device for supplying a developing bias voltage capable of minimizing toner consumption by reducing wasted toner during a printing operation in the image forming apparatus. The image forming apparatus comprises a photosensitive drum for forming an electrostatic latent image, a charger for providing a predetermined charging voltage to the photosensitive drum such that different bias voltages are supplied to image and non-image areas, an exposure unit for forming the electrostatic latent image on the photosensitive drum by providing image data, a developing unit for developing the electrostatic latent image formed on the photosensitive drum by toner, a transfer unit for transferring the developed toner to a printing paper, and a developing bias controller.

3 Claims, 4 Drawing Sheets

METHOD AND DEVICE FOR SUPPLYING A VARIABLE BIAS VOLTAGE TO A DEVELOPING ROLLER

BACKGROUND OF THE INVENTION

1. Field of the Invention

The present invention relates to an image forming apparatus, and particularly to a method and a device for supplying a developing bias voltage capable of minimizing toner consumption by reducing wasted toner during printing operation in the image forming apparatus.

2. Description of the Related Arts

In an image forming apparatus, print data is converted to a a type of electrostatic latent image formed on a photosensitive drum by exposure to a light source such as laser beam, and the image is then developed on a paper sheet by using the toner. The need for reducing the amount of the wasted toner in such an image forming apparatus has been long appreciated.

FIG. 1 shows, as an example, a schematic view of a conventional image forming apparatus such as laser beam printer. The image forming apparatus includes a photosensitive drum 10 which serves as an image bearing member on which an electrostatic latent image is formed. A charger 12 provides a predetermined charging voltage to the photosensitive drum 10 and an exposure unit 14 forms the electrostatic latent image on the photosensitive drum 10 by scanning light from the exposing light source. A developing unit 16 develops the electrostatic latent image formed on the photosensitive drum by the toner, a transfer unit 20 transfers the toner developed on the photosensitive drum 10 to a printing paper sheet 18 by the developing unit, and a cleaning unit 22 removes the wasted toner attached to the photosensitive drum 10 after completion of the transfer process and the electrostatic latent image.

FIG. 2 shows a series of the printing process steps. The paper sheet contacts the photosensitive drum after it is picked up by a paper cassette and is then finally ejected through an ejecting roller. In further detail completion of the developing process on the electrostatic drum, the printing paper 300 is picked up by the paper cassette 24 and transferred to an area in contact with the photosensitive drum by a pickup roller, shown as printing paper 200 contacting the photosensitive drum. After that, this paper, shown as printing paper 100, is ejected through the ejecting roller. In this process, a run length A2 in which the formation and transfer of the image are performed, is called an image formative area, whereas other run lengths A1 and A3 are called non-image formative areas.

With reference to FIGS. 3A to 3D, the image formative area and the non-image formative area will be explained in detail. First of all, in FIG. 3A, a chosen position C on outer the surface of the photosensitive drum 10 is called a charging position, a position D a developing position, and a position T a transfer position, respectively. Assuming that a predetermined linear velocity generated in rotating the photosensitive drum 10 is regarded V, the distance Δ1C between the charging position C and the transfer position T is expressed as V×ΔtC and the distance Δ1B between the developing position D and the transfer position T is expressed as V×ΔtB. Further, the length of the printing paper becomes V×ΔtP. The values ΔtC, ΔtB, and ΔtP have a time interval which is shown in FIGS. 3B, 3C, and 3D. FIG. 3B shows the variation of the charging voltage according to the variation of time. FIG. 3C shows the variation of a developing bias voltage according to the variation of time. FIG. 3D shows the variation of a transfer voltage according to the variation of time.

On a time base, the time interval between the charging and transfer processes corresponds to the value ΔtC and the time interval between the developing and transfer processes corresponds to the value ΔtB. FIG. 3D, the printing paper contacts with photosensitive drum 10 in the run length A2 between the position A and the position B, at a position T. The run length A2 corresponds to the value tP, and the area to a position B' from a position A' which precedes the position A by ΔtB, corresponds to the value tP. Further, an area to a position B" from a position A" which precedes the position A by ΔtC, corresponds to the value tP. Therefore, the interval AB and the intervals A'B' and A" B" appearing at the charging and developing stages are included in the image formative area A2. In FIG. 3D, the run length A1 and A3 correspond to the non-image formative area. That is, when performing the transfer process at the position T, the run length is divided into the image and non-image formative areas according to the presence or absence of contact of the photosensitive drum 10 with the printing paper, whereas when preforming the charging and developing processes at the positions C and D, the run length is divided into the image and non-image formative areas according to time difference between the positions C, D, and T. Therefore, as mentioned above, the run length A1 and A3 shown in the drawings correspond to the non-image formative area, and also the run length A2 shown therein corresponds to the image formative area. Moreover, when continuously printing multiple papers, the portion between the printing papers corresponds to a non-image formative area.

FIG. 4 is a view showing characteristics of a conventional developing bias voltage. When printing an all black image, the typical developing bias operation will be explained hereinafter. At time t1 when beginning to the developing process, the surface of the photosensitive drum 10 is charged to a potential of approximately −600 volts provided from the charger 12. Then, the developing unit 16 is provided with a potential of approximately −450 volts and a main motor for rotating the photosensitive drum 10 is driven. Thereby, the photosensitive drum 10 and the developing unit 16 rotate in opposite directions. As the developing unit 16 rotates, the toner is provided to the contact surface between the photosensitive drum 10 and the developing unit 16. At times t2–t3 corresponding to the image formative area, output data is changed to the electrostatic latent image formed on the photosensitive drum 10 by irradiation of the exposure unit 14, so that a portion of the photosensitive drum where the electrostatic latent image is formed, comes to a potential of −50 volts. Then, the toner has a negative potential due to friction. Thus, after time t2, the portion of the photosensitive drum which is exposed by irradiation is developed by the toner from the developing unit 16 so that the electrostatic latent image is developed in accordance with the potential difference between the developing unit and the photosensitive drum. The toner is thereby attached to the exposed portion of the photosensitive drum. The toner developed on the photosensitive drum 10 is transferred onto the printing paper from the transfer unit 20. After time t3 corresponding to the non-image formative area, the photosensitive drum 10 is maintained to a potential of −600 volts by the charger 12. The run length A3 is completed at time t4. At times t1–t4, the toner which is attached to the photosensitive drum through the transfer unit 20, is transferred onto the printing paper. Then, the toner which is not transferred and is attached to the photosensitive drum 10 is removed by the cleaning unit 22 and is collected as the wasted toner.

However, as known, although times between t1 to t2 and t3 to t4 shown in FIG. 4 correspond to the non-image formative areas which are not exposed, the photosensitive drum 10 and the developing unit 16 are charged to potentials of −600 and −450 volts, respectively. At these times, toner having an opposite polarity is attached to the photosensitive drum 10 because the photosensitive drum 10 is charged to the negative potential in the non-image formative area. Here, the toner having an opposite polarity has a positive potential. Generally, most of the toner has a negative potential due to frictional charge. However, a part of the toner has a positive potential because the toner is relatively different in the characteristic of charge. This oppositely charged to the photosensitive drum passes through the cleaning unit 22 and then is ejected. Thereafter, this toner is collected as wasted toner. Therefore, the amount of wasted toner is increased and the ratio of the amount of toner used in practically printing per unit toner used is reduced. This causes excess toner to be used. Further, since the input of the toner frequently occurs due to the large amount of wasted toner, a vessel for collecting the wasted toner must be large. Thereby, it is difficult to produce a small and simple, wasted toner vessel.

SUMMARY OF THE INVENTION

It is therefore an object of the present invention to provide an operation method of an image forming apparatus capable of raising the percentage of toner actually used by reducing the amount of wasted toner.

It is another object of the present invention to provide an image forming apparatus having a small and simple vessel for collecting the wasted toner.

In accordance with the present invention, the image forming apparatus is adapted to provide different levels of developing bias voltages to a developing unit on the image and non-image formative areas, respectively. That is, in the non-image formative area, the developing bias voltage is provided to lower the potential difference between the photosensitive drum and the developing unit, thereby reducing the amount of the toner which has an opposite polarity and is attached to the photosensitive drum. On the other hand, in the image formative area, the developing bias voltage is provided to have the potential difference required in the developing process. Therefore, according to the present invention, the amount of toner which is attached to the photosensitive drum and then is collected, is sharply reduced in the non-image formative area. Thereby, it is possible to raise the percentage of toner actually used.

BRIEF DESCRIPTION OF THE DRAWINGS

The above and other objects, advantages and features of the present invention will be more apparent from the following detailed description taken with the attached drawings in which.

DETAILED DESCRIPTION OF THE PREFERRED EMBODIMENT

In the following description, it is assumed that the image forming apparatus such as a laser beam printer according to the present invention has a charging voltage of −600 volts, a developing bias voltage of −450 volts applied to the developing unit, and a developing bias voltage of −580 volts in the non-image formative area.

Figure 5:
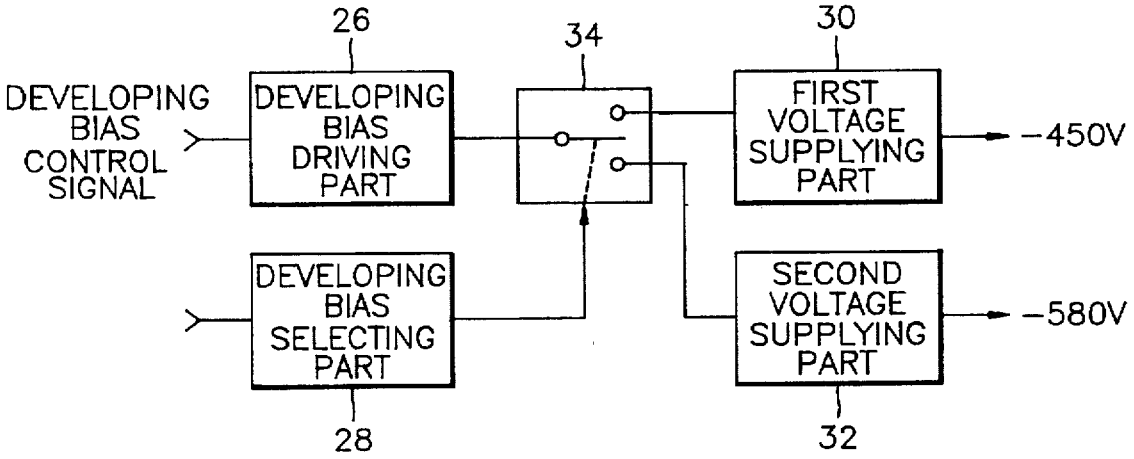
FIG. 5 is a block view showing a construction of a developing bias controller according to the present invention.

FIG. 5 is a block view showing a construction of a developing bias controller according to the present invention. FIG. 5, includes a developing bias driver 26 for outputting a driving signal which provides the developing bias voltage, in response to a control signal for indicating the application of the developing bias voltage; a developing bias selector 28 for outputting a first voltage selecting signal in the image formative area and for outputting a second voltage selecting signal in the non-image formative area; a first voltage supplier 30 for supplying a potential of −450 volts to the developing unit; a second voltage supplier 32 for supplying a potential of −580 volts to the developing unit, in response to the driving signal; and a driving selector 34 for transferring the driving signal to the first voltage supplier 30 when the developing bias selector outputs the first voltage selecting signal, and for transferring the driving signal to the second voltage supplier 32 when the developing bias selector outputs the second voltage selecting signal. Therefore, in case that the developing bias controller shown in FIG. 5 is commanded to provide the developing bias voltage, it selectively provides the potential of −450 or −580 volts to the developing unit according to the output of the developing bias selector.

Figure 1:
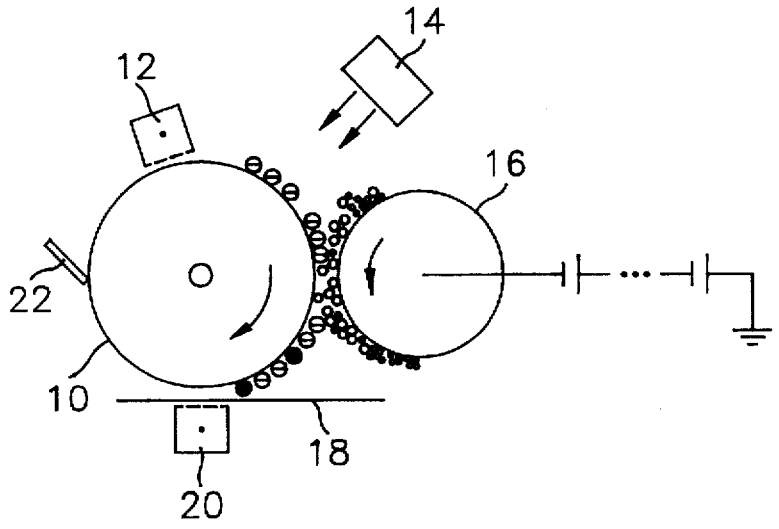
FIG. 1 shows a schematic construction of a conventional image forming apparatus.
Figure 2:
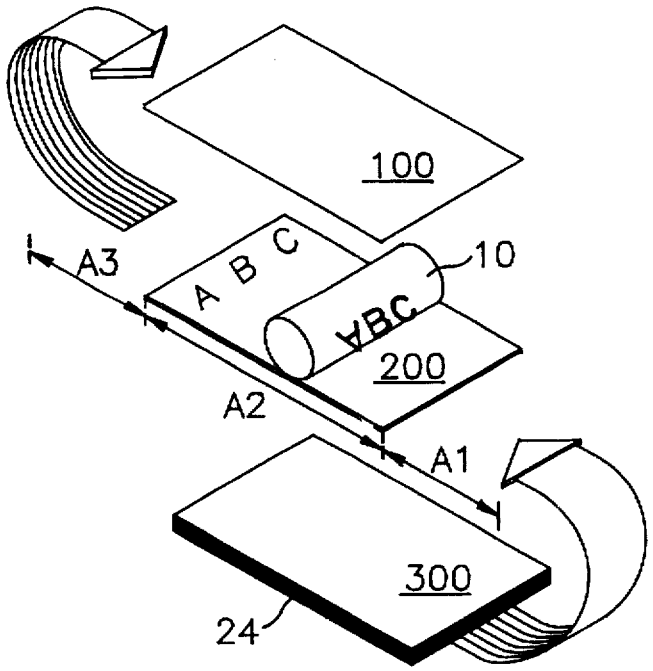
FIG. 2 shows a process of contacting a photosensitive drum with a printing paper.
Figure 3A:
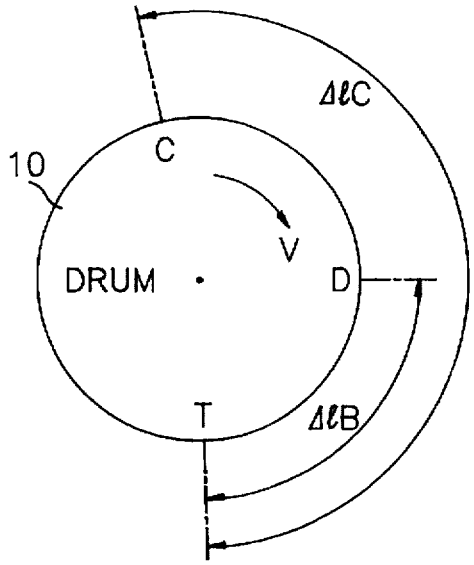
FIGS. 3A to 3D show an image and non-image formative areas according to the present invention.
Figure 6:
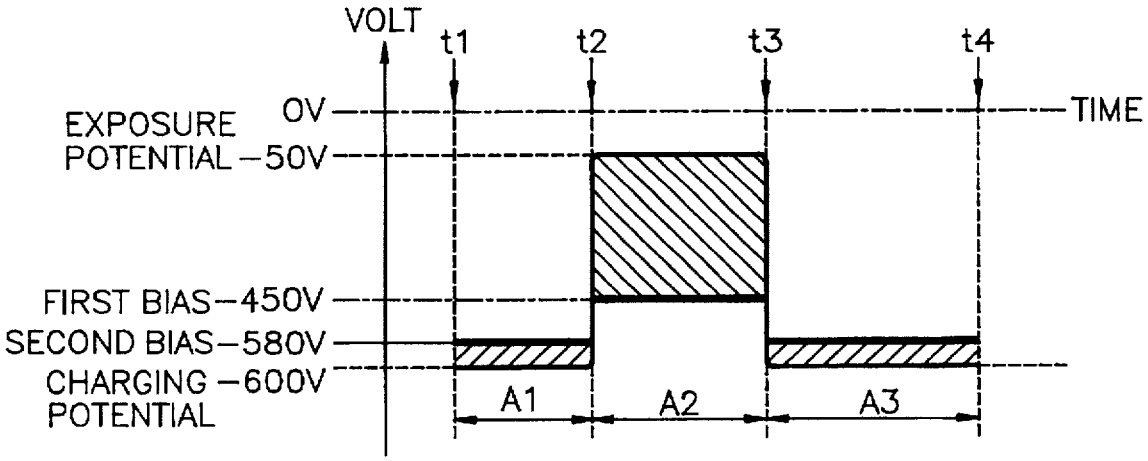
FIG. 6 is a view showing characteristic of a developing bias voltage according to the present invention.
Figures 3B, 3C, 3D:
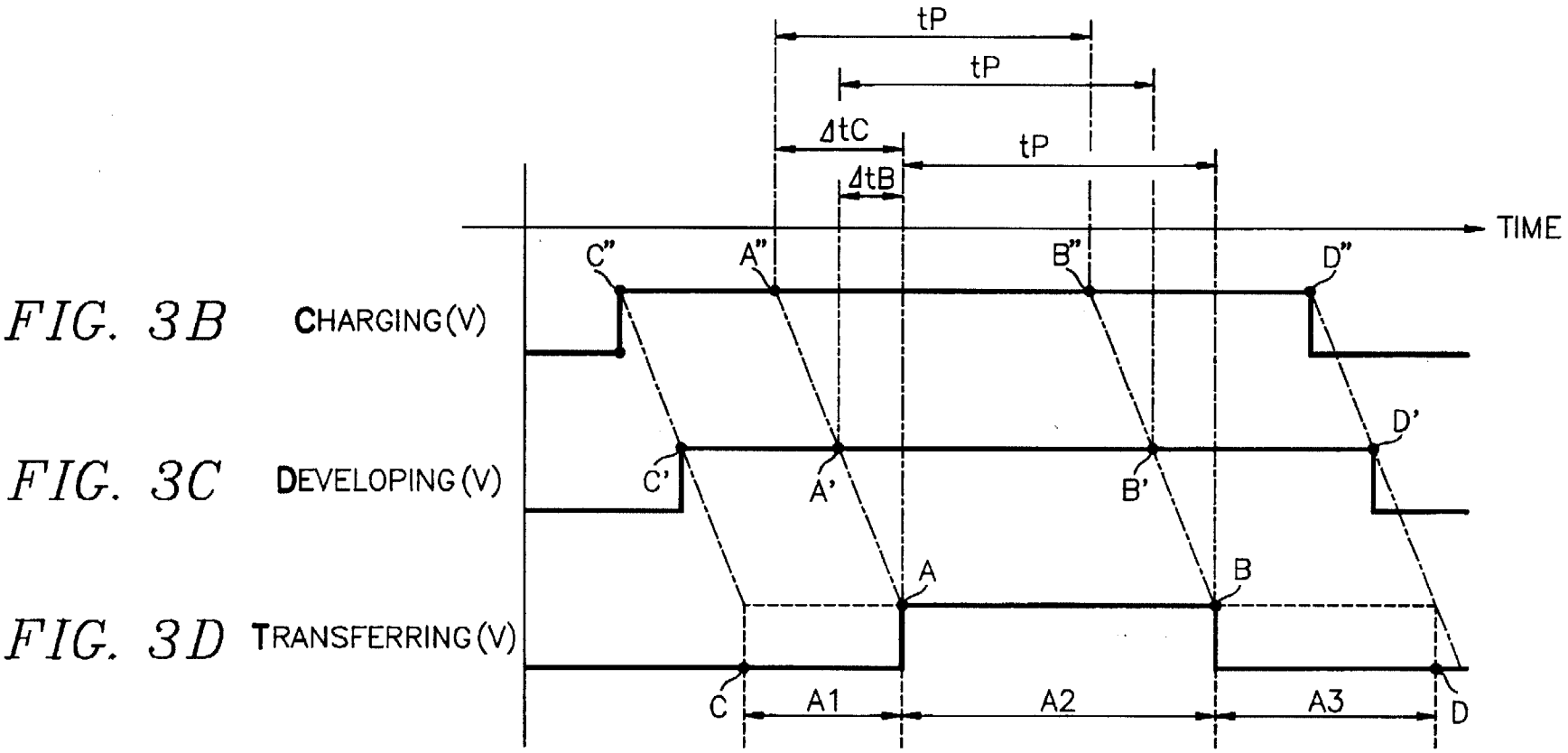
Figure 4:
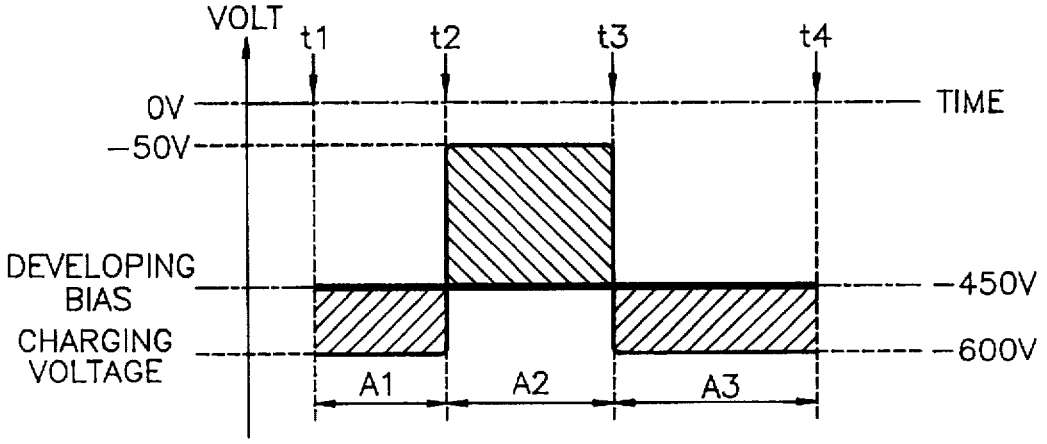
(CONVENTIONAL ART) FIG. 4
FIG. 4 is a view showing characteristic of a conventional developing bias voltage.

FIG. 6 is a view showing the characteristic of a developing bias voltage according to the present invention. With reference to FIGS. 1, 5, and 6, the printing operation according to the present invention will be explained for the case of printing a black image. Referring to FIG. 6, at time t1, when beginning the developing process, the surface of the photosensitive drum is charged to a potential of −600 volts by a negative potential provided from the charger 12. At this time, because exposure has not yet been begun the developing bias selector 28 switches the driving selector 34 so that the driving signal is supplied to the second voltage supplier 32. Thereby, the developing unit 16 is supplied with a potential of −580 volts. Therefore, the potential difference between the photosensitive drum 10 and the developing unit 16 becomes 20 volts. Since the potential difference is very low, unlike the conventional art, the amount of the toner which is oppositely charged is largely reduced. The Output data is changed to the electrostatic latent image formed on the photosensitive drum by irradiation of the exposure unit 14 at times t2 to t3. At this time, referring to FIG. 5, since the above times correspond to the image formative area, the developing bias selector 28 switches the driving selector 34 so that the driving signal is supplied to the first voltage supplier 30. Thereby, the developing unit 16 is supplied with a potential of −450 volts. The toner provided to the contact surface of the photosensitive drum and the developing unit reaches a negative potential state by friction. The portion exposed to the photosensitive drum 10 through the exposure unit 14, i.e., the portion forming the electrostatic latent image, has a potential of −50 volts. Thereafter, the portion exposed to the photosensitive drum 10 is developed by the toner from the developing unit 16, which toner is attached to the exposed portion by the potential difference between the portion exposed to the photosensitive drum having a potential of −50 volts and the developing unit having a potential of −450 volts. The toner developed on the photosensitive drum 10 is transferred onto the printing paper from the transfer unit 20.

At time t3, when the exposure is completed in the rear of the printing paper, the developing bias selector 28 switches the driving selector 34 so that the driving signal is supplied to the second voltage supplier 32. Thereby, the developing unit 16 is supplied with a potential of −580 volts. The potential difference between the photosensitive drum 10 and the developing unit 16 is maintained to 20 volts which is very low, thereby sharply reducing the amount of the toner attached to the photosensitive drum. Thereafter, at time T4, the operation of the charger 12 is completed. At times t1 to t4, the electrostatic latent image formed on the photosensitive drum passes through the transfer unit 20 and then is transferred onto the printing paper. At this time, the remaining toner which is not transferred and the toner which is attached to the photosensitive drum are removed by the cleaning unit 22 and then collected as wasted toner in the non-image formative area.

As shown in FIG. 6, at times t1 to t2 and t3 to t4 corresponding to the non-image formative area, when the exposure is not begun, the toner having the opposite polarity and being attached to the photosensitive drum, is sharply reduced according to the reduction of the potential difference between the photosensitive drum and the developing unit. That is, this means that the amount of the toner used in times t1 to t2 and t3 to t4 is largely reduced.

The inventors of the present invention obtained a following fact by the same image forming apparatus as the present invention. The result is given by the following Table (1).

TABLE 1

| Item | Prior Art | Art according to present invention | Remarks |
|---|---|---|---|
| Input of Toner | 150.0 g | 150.0 g | — |
| Collected Amount of Wasted toner | 49.3 g | 41.6 g | 15.6% Reduction |
| The number of Print paper | 2912 sheets | 3502 sheets | 20.3% Increment |
| Amount of toner Consumption Per one sheet | 51.7 mg/sheet | 42.8 mg/sheet | 17.2% Reduction |

As shown in the Table (1), the amount of the toner which can be collected after use thereof is largely reduced in the image forming apparatus according to the present invention. Thereby, it is possible to diminish the size of the vessel for collecting the wasted toner. Moreover, since the percentage of toner used is high, there aries an economic advantage.

Also, since the amount of toner used is reduced there is another advantage in that the environment can be more easily protected.

As mentioned above, the image forming apparatus according to the present invention differently supplies the developing bias voltage applied to the developing unit to the image and non-image formative areas. That is, the developing bias voltage is provided to lower the potential difference between the photosensitive drum and the developing unit, thereby largely reducing the amount of the toner which is attached to the photosensitive drum. On the other hand, the developing bias voltage is provided to have the potential difference required in the developing process in the image formative area. As a result, it is possible to sharply reduce the amount of the toner collected as wasted toner without having influence on the formation of the image in the image formative area and also is possible to raise the efficiency for the toner use.

What is claimed is:

1. A method for supplying a developing bias voltage in an image forming apparatus having an image bearing member for forming an electrostatic latent image, a charging member for providing a predetermined charging voltage to said image bearing member, an exposing member for forming said electrostatic latent image on said image bearing member, a developing member for developing said electrostatic latent image formed on said image bearing member by toner, and a transferring member for transferring the developed toner to a printing paper sheet, said method comprising the steps of:

predetermining first and second bias voltages, said second predetermined bias voltage being different than said first predetermined bias voltage;

constructing first and second voltage supplier circuits which respectively supply said predetermined first bias voltage to image formative areas of said image bearing member and said second predetermined bias voltage to non-image formative areas of said image bearing member; and controlling operation of said first and second voltage supplier circuits so that said first predetermined bias voltage is supplied to said image formative areas and said second predetermined bias voltage is supplied to said non-image formative areas, wherein an absolute value of said charging voltage is greater than that of said second predetermined bias voltage, said absolute value of said second predetermined bias voltage being greater than that of said first predetermined bias voltage.

2. An image forming apparatus having an image bearing member for forming an electrostatic latent image, a charging member for providing a predetermined charging voltage to said image bearing member, an exposing member for forming said electrostatic latent image on said image bearing member by providing image data, a developing member for developing said electrostatic latent image formed on said image bearing member by toner, and a transferring member for transferring developed toner to print paper, said apparatus comprising:

a first bias voltage supplier for supplying, a first predetermined bias voltage to an image formative area on which said electrostatic latent image is formed on said image bearing member;

a second bias voltage supplier for supplying a second predetermined bias voltage which is different than said first bias voltage to a non-image formative area where said printing paper does not contact said image bearing member; and a developing bias controller for controlling application of said first predetermined bias voltage to said image formative area and said second predetermined bias voltage to said non-image formative area, wherein an absolute value of said charging voltage is greater than that of said second predetermined bias voltage, said absolute value of said second predetermined bias voltage being greater than that of said first predetermined bias voltage.

3. An image forming apparatus comprising:

a driving signal generator for generating a driving signal for supplying a developing bias voltage;

a first bias voltage supplier for supplying a first predetermined bias voltage to a developing unit when said driving signal is input thereto;

a second bias voltage supplier for supplying a second predetermined bias voltage to a non-image formative area of said developing unit when said driving signal is input thereto; and developing bias means for applying said driving signal to one of said first voltage bias supplier and said second bias supplier, wherein an absolute value of a charging voltage is greater than that of said second predetermined bias voltage, said absolute value of said second predetermined bias voltage being greater than that of said first predetermined bias voltage.

* * * * *